United States Patent [19]

Baker et al.

[11] 4,043,160

[45] Aug. 23, 1977

[54] INTERNAL TOOLING FOR SWAGING APPARATUS

[75] Inventors: Charles Marvin Baker, Kirkland; Gene Bruce Foster, Seattle, both of Wash.

[73] Assignee: The Boeing Company, Seattle, Wash.

[21] Appl. No.: 641,956

[22] Filed: Dec. 18, 1975

[51] Int. Cl.[2] ..... B21D 22/10

[52] U.S. Cl. ..... 72/61; 72/370; 29/237; 29/523

[58] Field of Search ..... 72/61, 62, 370, DIG. 14; 29/237, 523

[56] References Cited

U.S. PATENT DOCUMENTS

| | | | |
|---|---|---|---|
| 3,627,336 | 12/1971 | Lawson | 72/61 X |
| 3,808,868 | 5/1974 | Wolfe | 72/370 X |

FOREIGN PATENT DOCUMENTS

| | | |
|---|---|---|
| 535,726 | 4/1941 | United Kingdom |

*Primary Examiner*—Leon Gilden

*Attorney, Agent, or Firm*—Christie, Parker & Hale

[57] ABSTRACT

Improved internal tooling for a swaging apparatus for attaching fittings to tubing. The tooling includes a draw bolt having a head at one end adapted to be connected to actuating means such as a hydraulic cylinder at its opposite end. A straight cylindrical resilient expander sleeve is coaxially disposed on the draw bolt and is bracketed by a pair of split, circular, anti-extrusion rings located in mating seats formed in facing end surfaces of the draw bolt head and a seal bushing. The facing surfaces of the head and bushing are further configured to include a ramp surface extending between the surface of the draw bolt and split ring seats.

11 Claims, 7 Drawing Figures

Fig. 1
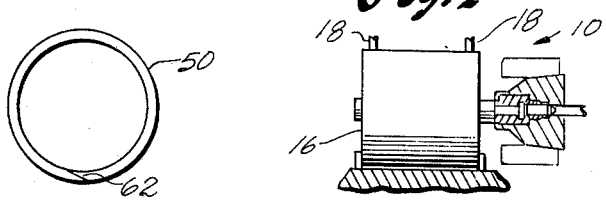
Fig. 6
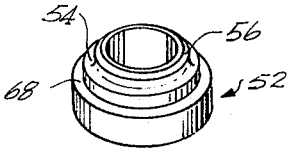
Fig. 7
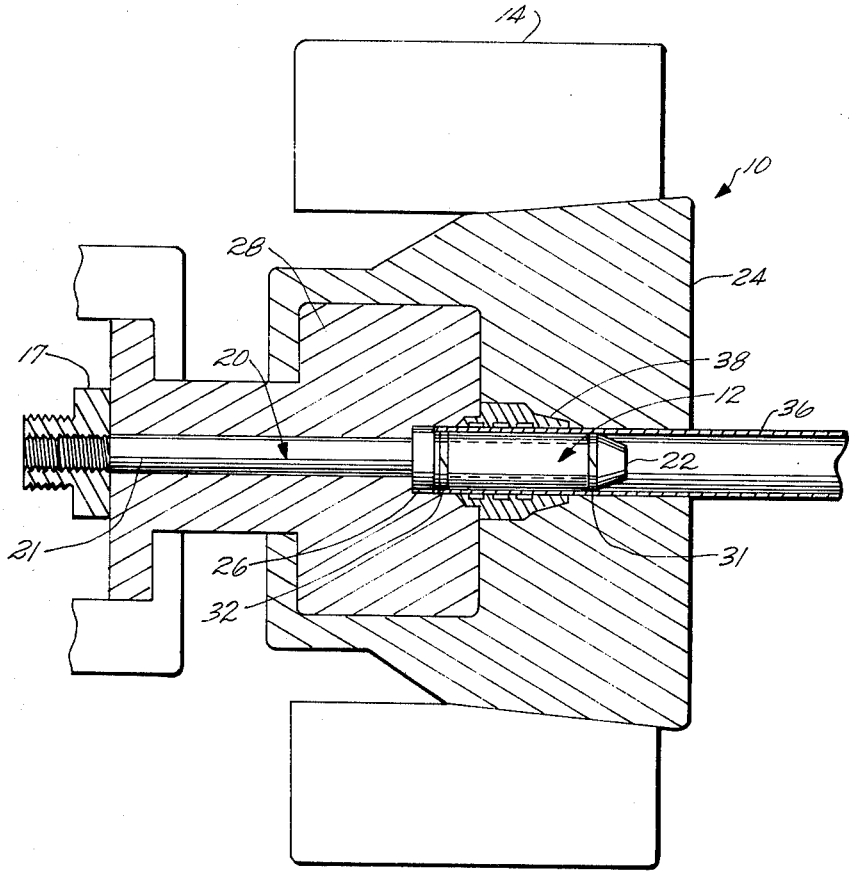
Fig. 2
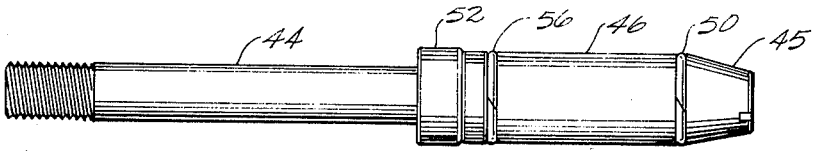
Fig. 3

INTERNAL TOOLING FOR SWAGING APPARATUS

BRIEF SUMMARY OF THE INVENTION

The present invention relates to swaging apparatus, and in particular to improvements in the internal tooling for such apparatus which, in conjunction with external tooling is used to affix a coupling sleeve member to thin wall tubing such as that used in aircraft tubing systems.

A swaging apparatus of the type to which the invention relates is described in U.S. Pat. No. 3,200,628. Likewise a specific configuration for prior art internal and external tooling for such a swaging apparatus is described in U.S. Pat. No. 3,627,336. Unions and joints in reconnectable aircraft tubing systems utilizing flareless thin wall tubing and swaged coupling sleeves are illustrated in U.S. Pat. No. 3,484,123. Coupling sleeve attachment is obtained by expanding the tubing wall into grooves in the internal wall of the coupling sleeve using a compressed elastomer. High internal pressures in the range of 100 ksi are required to obtain desired degree of groove fill.

In its basic elements the internal tooling of such a swaging apparatus comprises a draw bolt having a shank and a head. A resilient expander sleeve is coaxially disposed on the shank adjacent the head and a seal bushing is positioned on the shank interiorly of the expander sleeve. The expander sleeve (elastomer) is provided with reduced portions extending from each end of the main body of the sleeve to define a shoulder and a collar of expander material extending along the shank of the draw bolt. A pair of rectangular, split anti-extrusion rings bracket the main body portion of the expander sleeve and seat on the reduced portions thereof at each end. The rear ring abuts the seal bushing and the forward ring abuts the draw bolt head. An anti-extrusion ring is coaxially disposed about the draw bolt shank below the rear split ring in abutment with opposed surfaces of the seal bushing and the expander sleeve.

The foregoing internal tooling configuration has been found to exhibit a number of problems, including limited tooling life and significant problems resulting from the scoring of the internal surface of the tubing walls particularly by the forward split ring as it moved relative to the tubing internal wall during the retraction stroke of the draw bolt to axially compress and radially expand the elastomer.

The present invention eliminates the problems of the prior art apparatus and simplifies its design by providing internal tooling for swaging apparatus, comprising a draw bolt having a shank and an enlarged coaxial head located at one end of the shank. The end surface of the head extending from the shank to the peripheral surface of the head defines a seat for an anti-extrusion ring. A sleeve of resilient material is coaxially disposed on the shank adjacent the draw bolt head and a bushing is coaxially disposed on the shank on the side of the resilient sleeve opposite the head, the bushing end surface adjacent the sleeve also defining a seat for an anti-extrusion ring. A pair of radially expandable, anti-extrusion rings are located in the seats of the head and bushing, respectively, and abut the opposite ends of the sleeve.

The present invention reduces internal tube surface marking to acceptable levels and provides substantially increased tool life. The design of the present invention of internal tooling is applicable to all tubing materials, soft as well as high strength materials. In comparison to the prior art design the draw bolt head configuration is modified to provide a seat for the forward split ring and a ramp extending from the shank to the lower edge of the seat. The primary benefit of this change is that the seat reduces the radial forces exerted on the ring by the expander sleeve by restricting the flow of expander sleeve material under the ring. The design also results in a more positive seal, since initial compression of the expander sleeve causes a force parallel to the draw bolt axis to be exerted on the split ring forcing it against the draw bolt head and closing the gap at the split preventing extrusion of sleeve material through the gap. As compression of the sleeve continues, the sleeve material is forced under a portion of the forward split ring, exerting a radial force outwardly to cause the ring to form a second seal against the tube wall.

The ramp-seat configuration of the draw bolt region between shank and head provides a more gradual transition eliminating failures of the draw bolt head due to the severe stresses encountered because of the abrubt cross-sectional configuration changes of the prior art draw bolt. The present invention also provides that the expander sleeve be fabricated in a simple, straight cylindrical shape suitable for casting and eliminates the reduced portions which define a shoulder and collar at each end of the prior art sleeve. The anti-extrusion ring cross-section is also changed from rectangular to circular, thereby minimizing surface contact between the ring and the interior of the tube which is telescoped over the draw bolt assembly when the swaging apparatus is in operation. This reduction in surface contact in conjunction with reduced radial forces exerted on the ring by the sleeve collars reduces or eliminates tube marking and scoring problems. The circular configuration of the ring also means that available materials, such as music wire and the like, can be utilized to produce the ring, eliminating the necessity for a machine-fabricated square or rectangular split ring.

Finally, the seal bushing configuration is altered to provide a ramp-seat configuration on the end surface adjacent the sleeve which is a mirror image of the ramp-seat configuration in the draw bolt head. In the case of the bushing, the ramp is elastically deformed as the expander sleeve is compressed, sealing the gap between the bushing bore and the draw bolt eliminating the need for the anti-extrusion ring utilized in the prior art design.

These and other advantages will be better understood by reference to the accompanying drawings.

BRIEF DESCRIPTION OF THE DRAWINGS

FIG. 1 is an elevation view, partially in section, of a prior art swaging apparatus;

FIG. 2 is an enlarged cross-sectional elevation view of the internal and external tooling portion of FIG. 1;

FIG. 3 is a plan view of a draw bolt assembly (internal tooling) according to the present invention;

FIG. 6 is a plan view of a split ring according to the present invention; and FIG. 7 is a perspective view of the seal bushing according to the present invention.

DETAILED DESCRIPTION OF THE INVENTION

Figure 4:
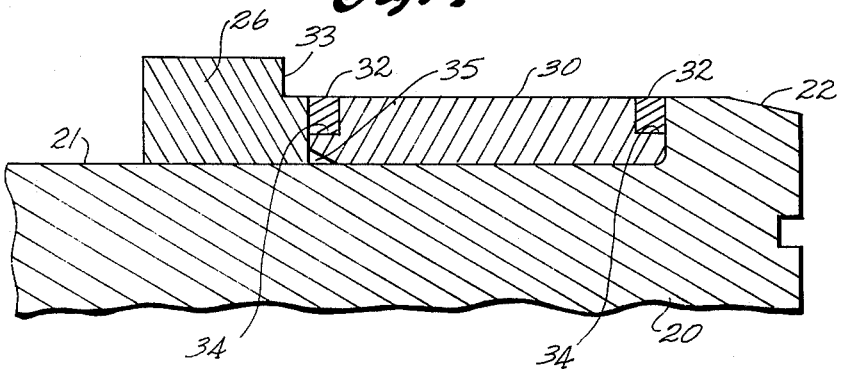
FIG. 4 is a cross-sectional view of the prior art draw bolt assembly (internal tooling) of FIG. 2.

A tube swaging device 10 including a resilient expander sleeve-draw bolt assembly 12 is shown in FIGS. 1 and 2. The swaging device 10 utilizes a hydraulic cylinder 16 which is operatively linked to the expander sleeve-draw bolt assembly. The internal tooling is so-called because it is adapted to be located within a tube and sleeve combination to be swaged together. The tube swaging device is completed by a set of tooling called external tooling adapted to surround and hold the tube and sleeve and guide the internal tooling during the swaging operation. A piston (not shown) is movable in cylinder 16 and is connected by means of a threaded adaptor 17 to the sleeve-draw bolt assembly 12. Hydraulic lines 18 are provided on the cylinder through which the ends of the cylinder may be selectively pressurized and vented, to move the piston in either direction in the cylinder.

Assembly 12 is connected to the piston and adaptor at a threaded end of the shank 21 of the draw bolt 20. An integral, enlarged head 22 is formed at the opposite end of draw bolt 20. A pair of split rings 31, 32 bracket a resilient expander sleeve 30 which is located interiorly of head 22 on the draw bolt. A seal bushing 26 seats against and between split ring 32 and an anvil 28 which surrounds the inner end of the draw bolt. The internal tooling is completed by an anti-extrusion ring (FIG. 4) 35 coaxially disposed about the draw bolt and located under ring 32 between seal bushing 26 and sleeve 30.

The external tooling comprises a three segment split die assembly 24, a die closing ring 14, as well as the anvil 28 and adaptor 17 previously referred to. The hydraulically actuated die closing ring closes the split die on the tube and sleeve when they have been properly indexed on step 33 provided on seal bushing 26 and on the indexing surfaces of anvil 28. The anvil works in conjunction with the split die to confine the sleeve and also serves to locate the sleeve and tube end (via the bushing) in the proper relationship and prevents expansion of the tube and coupling sleeve during compression of the resilient expander sleeve.

During a swaging operation, the hydraulic cylinder 16 is pressurized to retract the draw bolt. The head of the draw bolt 22 moves toward the cylinder while the seal bushing 26 is retained stationary by the anvil 28. Accordingly, retraction of the draw bolt is effective to cause compression of resilient sleeve 30 and a radial outward expansion against the interior of the tube wall located directly opposite grooves in the sleeve to which the tube is to be swaged.

As shown in FIG. 2 a tube 36 to be swaged to a surrounding sleeve 38 is telescoped over the draw bolt 20, seal bushing 26, expander sleeve 30, and split rings 31, 32. The cylinder 16 is pressurized to retract the draw bolt and axially compress the expander sleeve 30 between the split rings. The resultant radial outward expansion of sleeve 30 against the surrounding tube 36 forces the facing portion of the tube into interlocking fluid sealing and axial load carrying engagement with the coupling part 38. During this axial compression of sleeve 30, collars 34 on the sleeve are also compressed and expand radially outwardly, deforming split rings 31, 32 radially out against the inner surface of the tube 36 to inhibit or prevent extrusion of the sleeve material through the small, annular clearance spaces between the tube and the draw bolt head 22 at one end and the tube and seal bushing at the other end.

The scoring or marking previously referred to of the tube interior is due to the edges at the corners and along the split of the split rings 31, 32 coming in contact with the tubing particularly front ring 31 which moves with the draw bolt. Because of the reduced portions defining collars 34 at each end of sleeve 30, radial loads exerted on the split rings not only causes them to expand, but also causes the split to open. The material of sleeve 30 is then allowed to escape through the resulting gap.

The draw bolt assembly, according to the prior art, is further illustrated by the cross-sectional view of FIG. 4. An anti-extrusion ring 35 circumscribes the draw bolt and is shaped so as to seat on shank 22 between seal bushing 26 and pressure sleeve 30. The interior wall of sleeve 30 is likewise complimentarily chamfered so as to receive and seat on the anti-extrusion ring. As draw bolt 20 is hydraulically drawn toward seal bushing 26 during swager operation, a component of force directed parallel to the axis of the draw bolt exerts pressure on anti-extrusion ring 35 preventing the extrusion of elastomer material from sleeve 30 into the bore of seal bushing 26. As another problem characteristic of the prior art design, ring 35 fabricated of a soft metal, is subject to fatigue and substantial wear, necessitating frequent replacement.

Figure 5:
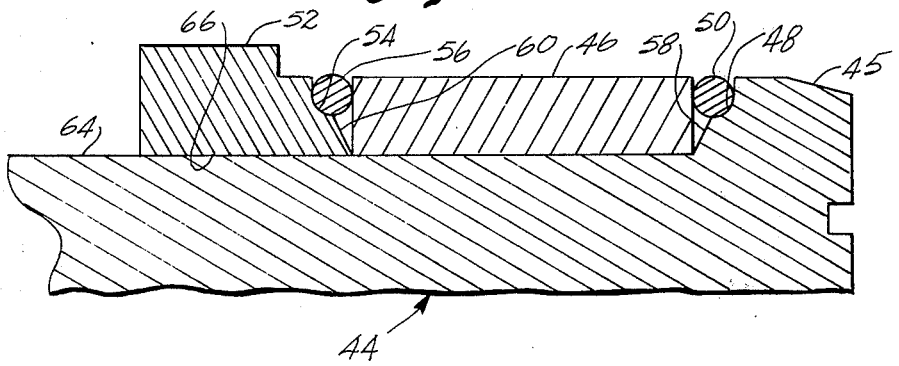
FIG. 5 is a cross-sectional view of the draw bolt assembly (internal tooling) according to the present invention.

To avoid the foregoing problems inherent in the operation of the draw bolt of the prior art a modified design for the draw bolt assembly as shown in FIGS. 3 and 5 has been developed. In this assembly a draw bolt 44 is provided having a head with a modified cross-sectional configuration at the end surface of the head adjacent the expander sleeve. This modified cross-sectional configuration provides an arcuate seat 48 for receiving an anti-extrusion split ring 50 having a circular cross-section. Likewise, a seal bushing 52 disposed on the draw bolt and located at the interior end of an expander sleever 46, has a modified cross-section on the end surface adjacent sleeve 46 to provide an arcuate seat 54 for a second anti-extrusion split ring 56 again of a circular cross-section.

The present invention also entails a modified configuration for the expander sleeve 46 eliminating the shoulder and the collar of expander material located under the split rings of the prior art design. The expander sleeve according to the present invention has the configuration of a straight, right circular cylinder having no shoulder, undercuts, or coaxial collars at either end. The elimination of the shoulder-collar configuration of the expander sleeve enables the sleeve 46 to be fabricated by casting process and eliminates the need for the machining operations to produce the shoulder and collar thereby eliminating a step in the production of the expander and substantially decreasing the cost of the expander sleeve.

By providing a seat for the split ring 50, 56 on the draw bolt head and seal bushing, respectively, and eliminating the collar of expander material located beneath the split rings 31, 32 in the prior art, the high radial forces exerted by the collar of expander material on the split rings are eliminated. In addition, a more positive seal against extrusion of expander material is accomplished by the new seat design, since initial expander sleeve compression exerts an axial force on split rings 50, 56 parallel to the draw bolt center line, forcing the split rings against the draw bolt head and seal bushing which has the effect of closing the splits in the rings, preventing extrusion of material through the gap.

In addition to the circular arc cross-section of the seats 48, 54, ramps 58, 60 are located below the seats 48, 54 on the draw bolt head and seal bushing respectively, extending from the base of the seats to the shaft or shank 64 of the draw bolt. This imparts a more gradual sloping configuration to the cross-section of the head of the draw bolt and has been found to add significantly to the strength of the draw bolt head, eliminating failures due to the heads fracturing, rupturing or being pulled off the shanks. In the prior art draw bolt head configuration, very high stress levels were concentrated in the abrupt change of cross-sectional configuration at the shank head interface. The more gradual, sloping transition from shank to head eliminates this stress concentration and spreads it over a greater area of draw bolt material. The opposite end of the draw bolt is also modified to increase the diameter of the shank and threaded portion. Use of a modified thread configuration (UNJEF) results in the elimination of a sharp notch at the thread root of the prior art draw bolt.

The ramp design on the end surfaces of the seal bushing and draw bolt head adjacent the expander sleeve also enhances the seal produced by the split rings at the tube interior wall. Compression of the expander sleeve causes expander material to be forced under the rings and radial forces to be exerted on the underside of the rings causing them to form a second seal against the tube wall. The closing of the gap in the split rings and the action of the expander on the rings causing a seal against the tube wall provides an effective seal completely around the edge of the expander sleeve preventing the extrusion of expander material as the high compression forces are exerted thereon. The result is a substantial increase in the life of the expander ring, the increase being one the order of in excess of ten times the life of the prior art expander sleeve.

The redesign of the seats 48, 54 eliminates the use of the square or rectangular cross-sectional configuration of the prior art split rings 31, 32, replacing them with split rings having a circular cross-section. The advantage of such a circular cross-section is significant reduction in the amount of surface contact between the split rings and the interior wall of the tube to which the coupling sleeve is to be swaged. The reduction in surface area contact together with reduction in the amount of radial force which is exerted against the split rings by the elastomer of the expander also contributes significantly to the elimination of the scoring problem on the interior of the tube due to the rectangular split rings of the prior art design. As in the case of the expander, the new design of the split rings also results in a fabrication benefit, since the split rings can now be formed from available round wire products such as music wire in contrast to the necessity of machining wire stock to produce the prior art rectangular split rings.

As indicated above, the seal bushing configuration has been altered to provide a seat configuration identical to the configuration on the interior side of the draw bolt head. The ramp now provided has a second function. The expander material causes the ramp 60 located below seat 54 on seal bushing 52 to elastically deform when the expander is compressed thereby sealing the gap between the bushing bore 66 and the draw bolt shank 64. This enables the elimination of the anti-extrusion ring 35 of the prior art design.

Greater detail with respect to the design of the split rings and the seal bushing according to the present invention is seen by reference to FIGS. 6 and 7. One of the circular anti-extrusion rings 56 is shown with a diagonal cut or split 62 through the material of the ring. The cut lies along a plane which is inclined to the plane of the circle of ring 56. The diagonal split causes the opposing faces of the gap to slide with respect to each other when outward radial pressure is exerted by the expander material against the ring, enlarging the circumference of the ring and causing it to seal against the tube interior. The split also allows the rings to have a spring-like action permitting the tooling to accomodate changes in tubing diameter.

The modified configuration of the seal bushing is shown in the perspective view of FIG. 7. As shown therein, bushing 52 is circular having the annular seat 54 disposed below a step 68 which indexes and abuts against a length of tubing to which a coupling sleeve is to be swaged by the apparatus utilizing the internal tooling of the present invention. The annular ramp 56 is likewise shown. As indicated above, bushing 52 guides the draw bolt in its reciprocating axial motion to and from a hydraulic cylinder.

As the foregoing has demonstrated the improved internal tooling has numerous advantages derived from modification of draw bolt, split ring and expander sleeve configuration. These advantages include substantial increases in durability and service life of the equipment and a decrease in the overall cost of the tooling resulting from simplified manufacturing requirements and elimination of a tooling component.

We claim:

1. Internal tooling for a swaging apparatus comprising:

a draw bolt having a shank and an enlarged coaxial head located at one end of the shank, a shoulder extension on the end surface of the head facing the shank, said shoulder defining a seat extending a predetermined distance from the draw bolt head axially of the shank, a sleeve of a resilient material coaxially disposed on the shank adjacent the draw bolt head, a bushing coaxially disposed on the shank on the side of the resilient sleeve opposite the head, the bushing end surface facing the sleeve having a shoulder extension defining a seat extending a predetermined distance from the bushing axially of the shank, and a pair of radially expandable anti-extrusion rings disposed in and axially overlapping the seats in the head and bushing respectively and abutting the respective adjacent ends of the sleeve.

2. Tooling according to claim 1, wherein the anti-extrusion rings are circular in cross-section and are split at one point along their circumference along a plane which is inclined to the plane of the circle defined by the ring.

3. Tooling according to claim 2 wherein the seats on the draw bolt head and bushing end surfaces are arcuate and adapted to mate with the circular rings.

4. Tooling according to claim 3 wherein the end surface of the bushing defines an elastomer deforming ramp extending from the base of the seat to the bore of the bushing.

5. Tooling according to claim 4 wherein the sleeve is a straight, right circular cylinder.

6. Tooling according to claim 5 wherein the end surface of the draw bolt head is provided with an elastomer deforming ramp extending from the shank of the draw bolt to the base of the seat.

7. Tooling according to claim 1 wherein the cross-sectional configuration of the draw bolt in the transition region between the shank and the draw bolt head is inclined upwardly from the shank toward the head and forms an obtuse angle with the shank whereby the effect of pressure in the axial direction from the sleeve on the head is diminished and the mechanical strength of the draw bolt is increased.

8. Tooling according to claim 7 wherein the transition is provided by a combination of a ramp and an arcuate surface integrally formed in the interior surface of the draw bolt head whereby compression of the sleeve is translated into radial pressure on the anit-extrusion ring to seal said ring against the interior wall of tubing in which the draw bolt is placed.

9. Tooling according to claim 8 including a mirror image of the ramp-arcuate surface of the draw bolt head formed in the end surface of the bushing adjacent the sleeve.

10. Tooling according to claim 8 wherein the ramp of the bushing is elastically deformable.

11. In an apparatus for securing a circumscribing sleeve member to a tubular member utilizing a first set of tooling located externally of the sleeve and tubing member and a second set located internally of said members, the improvement of the second set comprising:

a draw bolt having a shank and an enlarged coaxial head located at one end of the shank, the end surface of the head extending between the shank and the peripheral surface of the head defining an arcuate seat;

an expander sleeve of a resilient material coaxially disposed on the shank adjacent the draw bolt head;

a seal bushing coaxially disposed on the shank on the side of the resilient sleeve opposite the head, the bushing end surface adjacent the sleeve defining an arcuate seat; and a pair of split, anti-extrusion rings of circular cross-section located in the seats of the head and bushing respectively and abutting opposite ends of the sleeve.

* * * * *